US010525493B2

(12) United States Patent
Rossignol

(10) Patent No.: US 10,525,493 B2
(45) Date of Patent: Jan. 7, 2020

(54) PUMP FOR A RECEPTACLE, IN PARTICULAR A BOTTLE FOR A COSMETIC PRODUCT, AND A DISPENSING DEVICE COMPRISING SUCH A PUMP

(71) Applicant: ALBEA LACROST, Lacrost (FR)

(72) Inventor: Eric Rossignol, Chalon sur Saone (FR)

(73) Assignee: ALBEA LACROST, Lacrost (FR)

( * ) Notice: Subject to any disclaimer, the term of this patent is extended or adjusted under 35 U.S.C. 154(b) by 0 days.

(21) Appl. No.: 15/431,804

(22) Filed: Feb. 14, 2017

(65) Prior Publication Data

US 2017/0246648 A1 Aug. 31, 2017

(30) Foreign Application Priority Data

Feb. 25, 2016 (FR) ..... 16 51581

(51) Int. Cl.

| | |
|---|---|
| ***B05B 11/00*** | (2006.01) |
| ***A45D 34/00*** | (2006.01) |
| ***A45D 40/00*** | (2006.01) |
| ***F04B 23/02*** | (2006.01) |
| ***F04B 43/02*** | (2006.01) |

(52) U.S. Cl.

CPC ..... *B05B 11/3035* (2013.01); *A45D 34/00* (2013.01); *A45D 40/0075* (2013.01); *B05B 11/3069* (2013.01); *F04B 23/028* (2013.01); *F04B 43/02* (2013.01)

(58) Field of Classification Search

CPC ..... B05B 11/3036; B05B 11/3028; B05B 11/3069; B05B 11/3033; B05B 11/3035; A45D 34/00; A45D 40/0075; F04B 43/02; F04B 23/028

USPC ..... 222/209

See application file for complete search history.

(56) References Cited

U.S. PATENT DOCUMENTS

| | | | | |
|---|---|---|---|---|
| 3,452,905 A * | 7/1969 | Micallef | ..... | B05B 11/3028 222/207 |
| 6,755,327 B1 | 6/2004 | Hazard et al. | | |
| 7,028,865 B2 * | 4/2006 | Heukamp | ..... | B05B 11/007 222/207 |

(Continued)

FOREIGN PATENT DOCUMENTS

| | | |
|---|---|---|
| FR | 2900643 A1 | 11/2007 |
| FR | 2804728 A1 | 10/2008 |

(Continued)

*Primary Examiner* — Paul R Durand
*Assistant Examiner* — Robert K Nichols, II
(74) *Attorney, Agent, or Firm* — Banner & Witcoff, Ltd.

(57) ABSTRACT

A pump for a receptacle (10), in particular a bottle intended to contain a cosmetic product. The pump (1) has a pumping chamber (8) with a variable volume defined at least partly by a deformable membrane (3). The pump (1) functioning by varying the volume of the chamber (8) by elastic deformation of the membrane (3) between an initial state in which the chamber (8) has a maximum volume and a deformed state in which the volume of the chamber (8) is minimum. The chamber (8) being provided with an inlet orifice (22) and an outlet orifice for the product. The pump (1) has a means for deforming the membrane configured to exert a pressure on the membrane (3) and a guide rod (20) passing through the membrane (3). The membrane (3) slides along the rod (20) when it undergoes said deformation.

17 Claims, 3 Drawing Sheets

(56) References Cited

U.S. PATENT DOCUMENTS

| | | | | |
|---|---|---|---|---|
| 2009/0065531 | A1* | 3/2009 | Decottignies ..... | B05B 11/3028 222/207 |
| 2014/0183229 | A1* | 7/2014 | Van Swieten ..... | B05B 11/0048 222/256 |
| 2016/0332181 | A1* | 11/2016 | DeMan ..... | B05B 11/3001 |

FOREIGN PATENT DOCUMENTS

| | | | |
|---|---|---|---|
| FR | 2915467 | A1 | 10/2008 |
| JP | 2007289840 | A | 11/2007 |
| WO | 2013135883 | A1 | 9/2013 |

* cited by examiner

PUMP FOR A RECEPTACLE, IN PARTICULAR A BOTTLE FOR A COSMETIC PRODUCT, AND A DISPENSING DEVICE COMPRISING SUCH A PUMP

CROSS-REFERENCE TO RELATED APPLICATIONS

This application claims benefit of French Application No. 1651581 filed Feb. 25, 2016, hereby incorporated by reference in its entirety.

FIELD

The invention relates to a pump for a receptacle, in particular a bottle for a cosmetic product. The invention also relates to a receptacle comprising such a pump.

BACKGROUND

Some bottles for cosmetic products are provided with a pump configured to aspirate the cosmetic product contained in the reservoir of the bottle in order to dispense it, for example by means of a nozzle or through a simple opening. The product can thus be extracted or atomised from the bottle in order to allow application thereof. The pump is often actuated by means of a push button on which the user exerts pressure in order to trigger the functioning of the pump. A pump comprises in particular a pumping chamber, the volume of which varies to allow aspiration of the product in the chamber through an inlet orifice, when the volume increases, and then expulsion thereof out of the chamber through an outlet orifice, when the volume in the chamber decreases. The product emerges from the chamber in a dispensing pipe, which leads it to the opening or nozzle normally arranged on the push button.

Various kinds of pump are known, each having particular characteristics, in order to function specifically either with low-viscosity liquid products or with viscous liquid products such as creams or foams. Thus there exist pumps, the chamber of which is formed by a rigid body and a piston that closes off the chamber, and the movement of which in the body reduces or increases the volume of the chamber. The movement of the piston is in general controlled by actuating the push button. Such a pump is used in particular for liquid products to be vaporised.

There exist other pumps generally intended for more viscous products, the chamber of which is defined to a great extent by a flexible membrane, also referred as a "bellows". The volume of the chamber is controlled by deformation of the membrane. In the non-deformed configuration of the membrane, the volume of the chamber is maximum. When the membrane is deformed, the volume of the chamber decreases, preferably to a volume low enough for a maximum amount of product to emerge from the chamber. Such pumps also have the advantage of avoiding having to use a metal spring, the components of the pump being made from plastics material.

The document FR 2804728 is for example known, which describes a deformable-membrane pump provided with slots as inlet and outlet orifices for the pumping chamber. In this pump, the membrane has a particular form and is held in a compartment to control the way in which it folds and unfolds. This is because it is wished to prevent the membrane deforming in an undesired configuration, which would risk damaging it and impairing the correct functioning of the pump.

Another document FR 2915467 shows a pump with a membrane having a bellows form in the form of an accordion. The bellows folds and unfolds along folding lines of the bellows. However, the membrane is divided into a plurality of parts attached firstly to the push button and secondly in the body of the pump. Such a pump is consequently difficult to assemble and therefore complex and expensive to manufacture.

SUMMARY OF SELECTED INVENTIVE ASPECTS

The invention aims to improve the situation by avoiding the aforementioned faults, providing a pump provided with a deformable membrane made in a single piece, the deformation of which is guided to provide optimum folding, without having to constrain the membrane in a compartment or giving it a complex form.

For this purpose, aspects of the invention relate to a pump for a receptacle, in particular a bottle intended to contain a cosmetic product, said pump comprising a pumping chamber with a variable volume defined at least partly by a deformable membrane, the pump functioning by varying the volume of the chamber by elastic deformation of the membrane between an initial state in which the chamber has a maximum volume and a deformed state in which the volume of the chambers is minimum, the chamber being provided with an inlet orifice and an outlet orifice for the product, the pump comprising a means for deforming the membrane configured to exert a pressure on the membrane, the pump further comprising a guide rod passing through the membrane, the membrane sliding along the rod when it undergoes said deformation.

Thus aspects of the invention make it possible to guide the membrane when it undergoes the deformation by virtue of the guide rod, and to prevent the membrane folding in a way that is detrimental for the pump. This is because the membrane slides along the rod during its deformation so that the membrane is held radially with respect to the rod, and moves only along the axis of the rod.

According to various embodiments of the invention, which can be taken together or separately:

- the membrane has a form having a longitudinal axis in the initial state,
- the rod is disposed substantially along said longitudinal axis,
- the membrane has a dome shape in the initial state,
- the membrane is formed from a single elastic material,
- the membrane is formed from polymer material, for example from thermoplastic elastomer of the TPE type,
- the dome comprises a rounded base and a crown,
- the longitudinal axis of the membrane passes substantially through the centre of the base and through the crown of the dome,
- the rod passes through the dome from the base to the crown,
- the dome is configured so as to fold its crown towards its base,
- the membrane comprises an appendage disposed at the crown of the dome,
- the dome defines the internal volume of the pumping chamber,
- the rod passes through the appendage so that the appendage slides along the rod when the membrane deforms,
- the deformation means is a dispensing pipe in contact with the membrane, the pipe cooperates with the outlet orifice sealingly so as to receive the product emerging from the chamber,
the rod emerges from the appendage in the dispensing pipe,
the rod comprises a head holding the appendage,
the dome is under slight elastic constraint in the initial position,
the elastic constraint of the dome makes it possible to constrain the appendage against the rod in order to ensure a seal between them,
the outlet orifice is arranged on the membrane,
the outlet orifice is arranged on the appendage,
the outlet orifice is a slot,
the membrane undergoes a friction force against the rod during the deformation so as to cause opening of the slot,
the pump comprises a cylindrical coupling provided with a support wall on which the deformable membrane at least partly rests,
the guide rod extends in the cylindrical coupling from the support wall,
the rod passes axially through the pumping chamber,
the pump comprises a push button provided with the pipe for dispensing the product,
the push button comprises an outlet opening for the product in communication with the dispensing pipe,
the push button is formed from a material of the polypropylene type,
the cylindrical coupling comprises means for guiding the push button,
the appendage is inserted in the dispensing pipe,
the appendage comprises an end gripping the rod so as to create said friction force,
the support wall comprises the inlet orifice of the chamber,
the inlet orifice is a through hole,
the membrane is provided with a flange covering the inlet orifice so as to form an inlet valve for the chamber,
said pump comprises means for holding the membrane on the support wall,
the cylindrical coupling comprises an inner cylinder and an outer cylinder, concentric with each other,
the cylindrical coupling comprises a removable bottom carrying said support wall,
the internal cylinder comprises a notch for holding the membrane,
the membrane is provided with a rim arranged so as to be locked by the holding notch,
the push button comprises a cylindrical body configured so as to move between the internal and external cylinders of the cylindrical coupling,
the cylindrical coupling comprises a plunger tube intended to be introduced into the reservoir of the receptacle,
the plunger tube emerges on the inlet orifice of the chamber Aspects of the invention also relate to a receptacle, in particular a bottle for a cosmetic product, comprising a pump as mentioned previously.

BRIEF DESCRIPTION OF THE DRAWINGS

The invention will be understood better in the light of the following description, which is given only by way of indication and does not aim to limit it, accompanied by the attached drawings.

DETAILED DESCRIPTION OF EXAMPLE EMBODIMENTS

Figure 1A:
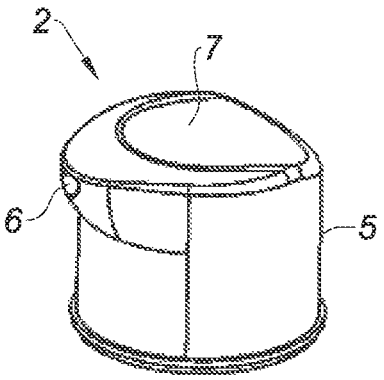
FIG. 1A to 1C illustrating schematically perspective views of the elements of a pump according to a first embodiment of the invention, FIG. 2A to 2E illustrating schematically views in cross section showing the functioning of the pump on a receptacle according to the first embodiment, FIGS. 3A and 3B illustrating schematically enlarged views in cross section showing the sliding of the membrane against the rod, FIG. 4 illustrating schematically an enlarged view in cross section showing the functioning of an inlet valve of the chamber, FIG. 5 illustrating schematically a perspective view of a cylindrical coupling according to a variant of the first embodiment of the invention, FIG. 6 illustrating schematically a view in cross section of the cylindrical coupling according to the variant of the first embodiment, FIG. 7 illustrating schematically a view in cross section of a pump according to a second embodiment of the invention, FIG. 8 illustrating schematically an air intake passage of the second embodiment.
Figure 1B:
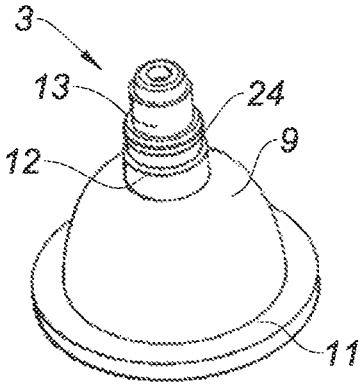
Figure 1C:
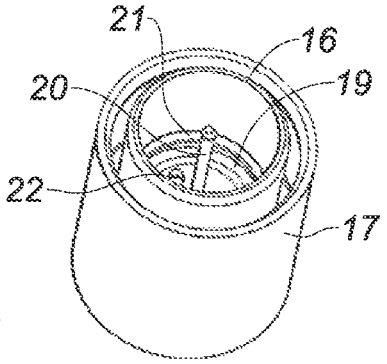

Aspects of the invention relate to a pump 1 for a receptacle 10, in particular a bottle intended to contain a cosmetic product. In a first embodiment depicted in FIG. 1A to 1C, and FIGS. 2 and 3, the pump comprises a push button 2 (FIG. 1A), a deformable membrane (FIG. 1B) and a cylindrical coupling 4 (FIG. 1C). The function of the push button 2 is to allow actuation of the pump 1 by a user. The push button 2 here has a cylindrical body 5 provided with an opening 6 for dispensing product and a top pressing wall 7 on which the user exerts a pressure to actuate the pump 1, the push button 2 being inserted in the cylindrical coupling 4 during actuation. The push button 2 is for example formed from material of the polypropylene type.

The pump further comprises a variable-volume pumping chamber 8 defined at least partly by the deformable membrane 3. The pump 1 functions by varying the volume of the chamber 8 by elastic deformation of the membrane between an initial state shown in FIG. 2A in which the chamber 8 has a maximum volume and a deformed state shown in FIG. 2C in which the volume of the chamber 8 is minimum. The chamber 8 has a form having a longitudinal axis in the initial state, and here has a rounded dome shape 9 comprising a circular base 11 and a crown 12. The longitudinal axis of the chamber 8 passes substantially through the centre of the base 11 and through the crown 12 of the dome 9. The membrane 3 also has an appendage 13 surmounting the dome 9, the internal volume of the dome 9 and the appendage 13 defining the pumping chamber 8. The membrane 3 is here formed from a single elastic material, preferably a polymer material, for example from a thermoplastic elastomer (TPE). The membrane 3 is also provided at its base 11 with an inner flange 14, which is intended to position the dome 9 in the cylindrical coupling 4 and to serve as an inlet valve for the chamber 8. The longitudinal axis of the membrane 3 passes through the crown 12 and the appendage 13 and substantially through the centre of the base 11 of the dome 9. An outer rim 15 is arranged around the base 11 of the membrane 3 so as to serve as a means for holding the membrane 3 in the cylindrical coupling 4.

In FIG. 1C, the cylindrical coupling 4 comprises an internal cylinder 16 and an external cylinder 17, substantially concentric, which serve as means for guiding the push button 2. Thus the body 5 of the push button can move between the internal cylinder 16 and the external cylinder 17. The cylindrical coupling 4 is also provided with means 18 for coupling with the receptacle 10, with for example a snap-on system as shown in FIG. 2A to 2E. The snap-on system is here a ring arranged on the cylindrical coupling 4 and a counter-ring arranged on the receptacle 10, the ring being snapped under the counter-ring.

The cylindrical coupling 4 is also provided with a support wall 19 on which the deformable membrane 3 rests at least partly. Here the base 11 of the dome 9 and the internal flange 14 are in contact with the support wall 19. The internal cylinder 16 also comprises a holding notch 21 arranged on the internal face of the internal cylinder 16, so as to lock the membrane 3 against the support wall 19. The notch 21 holds the outer rim 15 of the dome 9. The support wall 19 of the cylindrical coupling 4 also comprises a through hole 22 that defines an inlet orifice of the pumping chamber 8. The hole 22 is covered by the internal flange 14 of the membrane when the membrane 3 is inserted in the cylindrical coupling 4, so as to form an inlet valve of the chamber 8. The flange 14 is also elastic since it is made from the same material as the membrane 3. Thus the flange 14 can lift in order to allow the product to enter the chamber 8.

Figure 5:
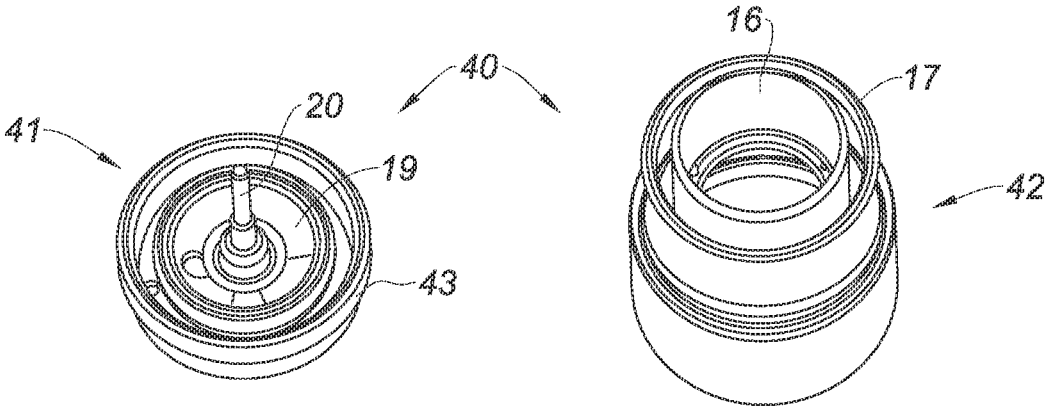
Figure 6:
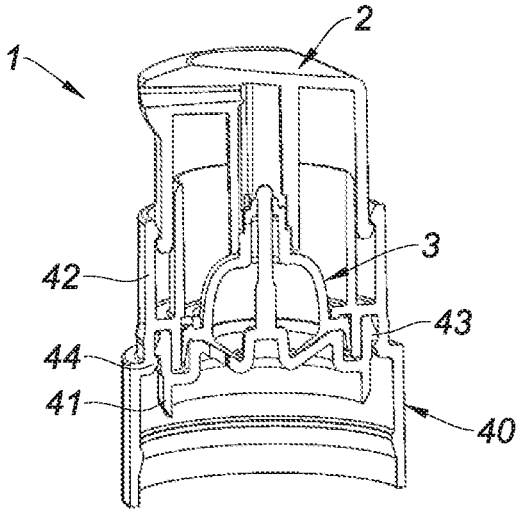

A variant embodiment of a cylindrical coupling 40 is shown in FIGS. 5 and 6. This cylindrical coupling 40 is provided with a removal bottom 41 and comprises in particular the support wall 19 and the rod 20. The element 42, which defines the other part of the cylindrical coupling 40, and the bottom 41 are arranged so as to be able to be assembled. For this purpose, the bottom 41 comprises a circumferential rib 43 that is locked by a snap-on notch 44 disposed inside the element 42, as shown in FIG. 6.

To deform the membrane 3, the pump 1 comprises a deformation means disposed outside the chamber 8 and configured so as to exert a pressure on the membrane 3 when the push button 2 is actuated. As shown by FIGS. 2 and 3, the deformation means is a dispensing pipe 23 having an open end 26 in contact with the membrane 3. The dispensing pipe 23 here forms part of the push button 2, the pipe extending inside the push button 2 from the internal face of the top wall 7. The function of the dispensing pipe 23 is to bring the product leaving the pumping chamber 8 to the opening 6 of the push button 2. The dispensing pipe 23 is in sealed contact with the membrane 3. For this purpose, the appendage 13 is inserted in the dispensing pipe 23, the pipe 23 resting on the dome 9 of the membrane 3. The appendage 13 is also provided with an external bead 24 that makes it possible firstly to lock it in the pipe 23 and secondly to provide the impermeability of the contact with the dispensing pipe 23. The bead 24 runs around the appendage 13, here at the junction of the dome 9, and is sized substantially to the dimensions of the open end 26 of the dispensing pipe 23.

The chamber 8 also comprises an outlet orifice for the product, the outlet orifice being arranged on the membrane 3, preferably on the appendage 13. The outlet orifice is here a slot 25 that opens when the pumping chamber 8 deforms. The dispensing pipe 23 cooperates with the slot 25 in order to receive the product emerging from the chamber 8. The slot 25 is disposed in the dispensing pipe 23 beyond the bead 24. Thus, when the product emerges from the slot 25 in the dispensing pipe 23, the product is guided in the dispensing pipe 23.

According to the invention, the cylindrical coupling 4 is provided with a rod 20 for guiding the membrane 3, which extends from the support wall 19 of the cylindrical coupling 4. The rod 20 is disposed substantially along the axis of the cylinders 16, 17 of the cylindrical coupling 4. The guide rod 20 passes through the membrane, so that the membrane 3 slides along the rod 20 when it undergoes said deformation, the rod 20 passing through the chamber 8 substantially along the longitudinal axis of the chamber 8. Here the rod 20 passes through the crown 12 of the dome 9 from its base 11, as well as the appendage 13, the rod emerging from the appendage 13 in the dispensing pipe 23. The crown 12 of the dome 9 and the appendage 13 thus have a through channel that enables the rod 20 to pass through the membrane 3.

The function of the rod 20 is to guide the membrane 3 when it passes from the initial state to the deformed state, and then from the deformed state to the initial state. The dome 9 is thus configured so as to able to fold its crown 12 towards its base 11, the appendage 13 of the membrane 3 also moving towards the base 11 of the dome 9, along the rod 20.

So that the slot 25, which is closed in the initial state (FIG. 3A), opens, the appendage 13 comprises an end 27 in tight contact around the rod 20. The rod comprises a retaining head 30 that bears on the end 27 of the appendage 13 in the initial position, so as to cause a slight elastic force on the dome. The elastic force makes it possible to constrain the end 27 of the appendage 13 against the rod 20 in order to provide the seal between them.

Figure 3A:
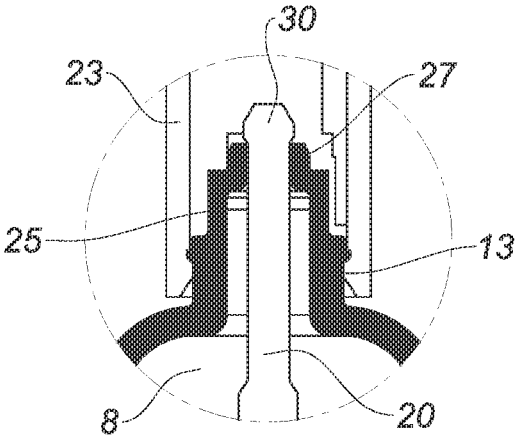
Figure 3B:
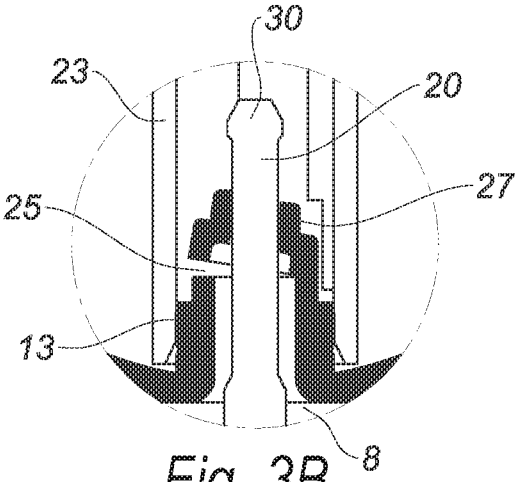

Moreover, the end 27 of the appendage 13 is subjected to friction against the rod 20 when the appendage 13 slides against the rod 20, so as to slightly stretch the appendage 13 and thus cause the opening of the slot 25, as shown in FIG. 3B. By virtue of this operating system, the invention makes it possible to open the outlet slot 25 for the product, without requiring any overpressure in the pumping chamber. In fact, the known membrane pumps provided with an outlet slot function by producing an overpressure inside the chamber, and therefore of the cosmetic product, to cause the opening of the slot. However, such overpressure risks damaging the product, by causing for example a phase separation, or the membrane by accelerating wear thereon.

Figure 2A:
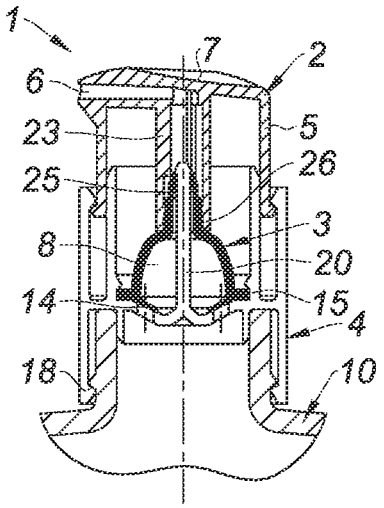
Figure 2B:
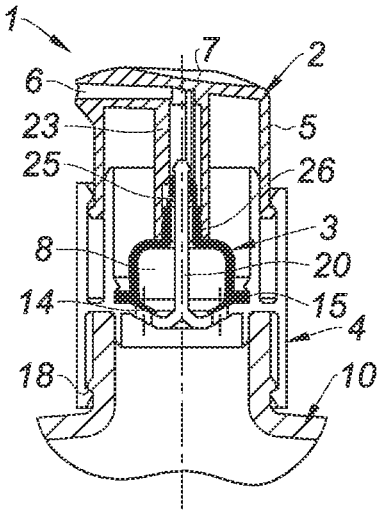
Figure 2C:
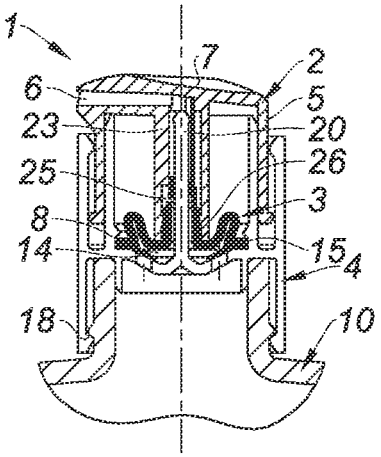

In FIG. 2A to 2C, when the membrane 3 is subjected to deformation, the membrane 3 slides along the rod 20 while folding, so that the volume of the chamber decreases. FIG. 2A shows the pump 1 in the initial state, in which the chamber 8 has its maximum volume. When the push button 2 is pressed in by the user, the dispensing pipe 23 bears on the dome 9, which begins to deform, as shown in FIG. 2A. The top of the dome 9 flattens, while the slot 25 opens. Here, the dome 9 folds first of all by sinking towards the base 11, the appendage 13 and the central part of the dome 9 on which the dispensing tube 23 exerts pressure. The product contained in the chamber 8 begins to be expelled through the slot 25. In FIG. 2C, the push button 2 is completely pressed into the cylindrical coupling 4, which causes the folding of the peripheral part of the dome 9, forming a circular ring. The ring is formed by two layers of membrane folded one against the other and forming an elbow. The chamber 8 thus reaches a minimum volume, preferably as small as possible, so that the maximum amount of product emerges through the slot 25.

Thus, by virtue of the rod 20, the membrane 3 remains centred around the longitudinal axis of the cylindrical coupling 4. The risk of a poorly controlled folding of the membrane 3 is thus avoided.

Figure 2D:
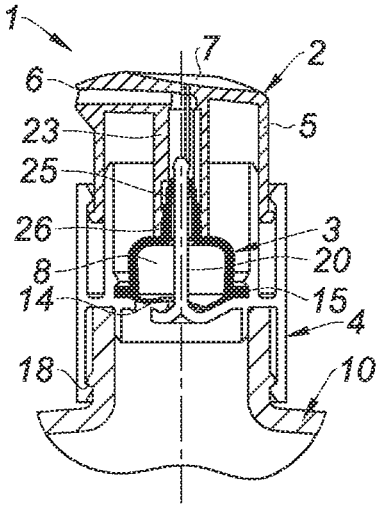
Figure 2E:
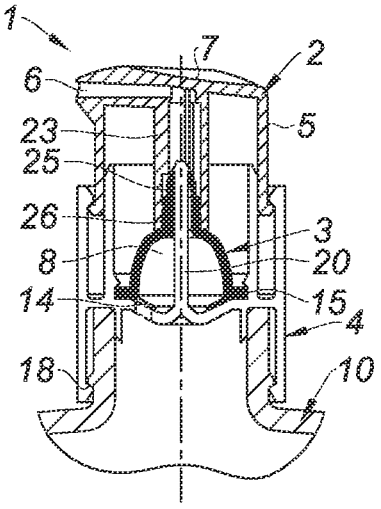

FIGS. 2D and 2E show the reversed deformation of the membrane, from the deformed configuration to the initial configuration. When the push button 2 is no longer kept pressed by the user, while the membrane is greatly deformed, the volume of the chamber is minimum and the membrane exerts a pressure force against the dispensing pipe 23, this force being due to the elastic character of the membrane 3, which tends to regain its initial shape. The push button 2 is thus pushed towards the outside of the cylindrical coupling 4 telescopically. The appendage 13 slides along the rod 20 in the opposite direction, which closes the slot 25 again because of the friction that is due to the end 27 clamped around the rod 20. The chamber 8 being closed, a negative pressure is created inside the chamber 8 since its volume increases without aspirating any air.

Figure 4:
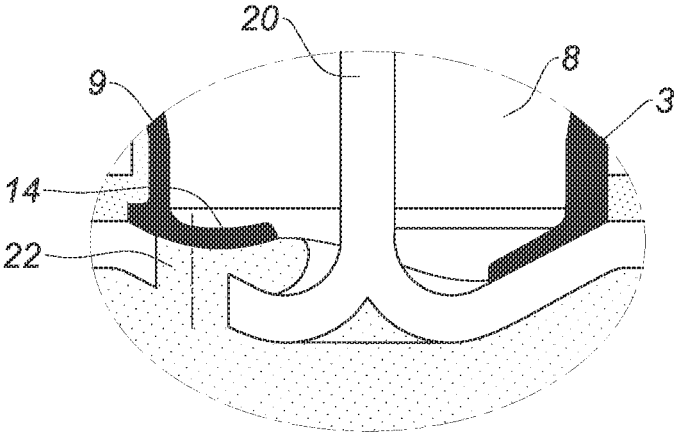

The negative pressure created in the chamber 8 forces firstly the flange 14 of the inlet valve to lift, and secondly causes the aspiration of the product into the chamber from the reservoir of the receptacle, as shown in FIG. 4. When the flange 14 lifts, the hole 22 is opened and puts the chamber 8 in communication with the reservoir of the receptacle. The product is thus aspirated through the hole 22 into the chamber 8 while the dome 9 resumes its initial shape. When the membrane 3 has completely regained its initial shape, the chamber 8 is reloaded with product to be dispensed, so that the pump 1 is once again usable.

In the first embodiment, the receptacle does not recover any external air in the reservoir in order to compensate for the discharge of product out of the chamber. The receptacle is preferably provided with a reservoir with a variable volume, which decreases as the product is dispensed. Thus the product is always in the vicinity of the inlet orifice in order to be aspirated into the chamber.

Figure 7:
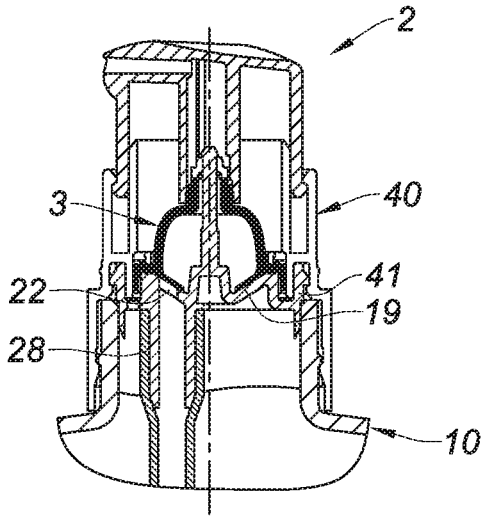
Figure 8:
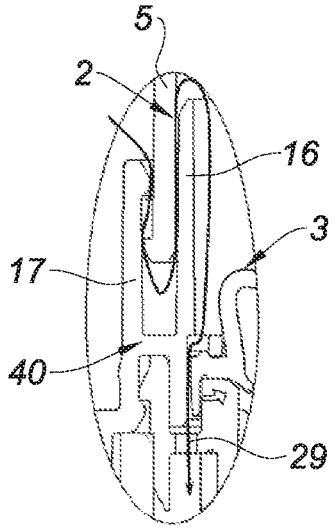

In a second embodiment, shown in FIGS. 7 and 8, the cylindrical coupling 40 also comprises a plunger tube 28, the cylindrical coupling 40 having in these figures a removable bottom 41 to which the plunger tube 28 is connected. The tube 28 is intended to be immersed in the reservoir of the receptacle 10, when the pump 1 is mounted on the receptacle 10. The tube 28 emerges in the support wall 19 of the cylindrical coupling 40 at the hole 22 of the inlet orifice of the chamber 8. Thus, when the pump 1 has been triggered, the product rises in the tube 28 by aspiration in order once again to fill the pumping chamber 8.

The pump 1 also comprises an air intake passage to make it possible to compensate for the negative pressure in the reservoir caused by the rising of the product from the reservoir of the receptacle into the chamber. As shown by FIG. 8, the air intake passage, which is represented by an arrow coming from the outside of the pump 1 into the reservoir, passes first of all between the external cylinder 17 of the cylindrical coupling 40 and the cylindrical body 5 of the push button 2, and then rises between the cylindrical body 5 of the push button and the internal cylinder 16 of the cylindrical coupling 40. The passage next descends again into the internal cylinder 16 of the cylindrical coupling 40 and passes through an opening 29 arranged in the bottom 41 of the cylindrical coupling 40, the opening 29 emerging in the reservoir. Thus the air flows through this passage in order to bring air in to the reservoir.

In this embodiment, the external rim of the base of the base of the membrane 3 is extended against the internal cylinder 16 of the cylindrical coupling 40 in order to form an air intake valve, above the opening. The air intake valve closes the opening 29 in the initial position and is folded towards the bottom of the cylindrical coupling 40. When a negative pressure is created inside the reservoir following the actuation of the pump, the valve moves as shown by the small white arrow in FIG. 8, so that the air can enter the reservoir through the opening 29. When the negative pressure disappears, the valve regains its initial shape by virtue of the elasticity of the membrane and thus prevents air from entering or product from leaving the reservoir.

The invention claimed is:

1. A pump for a receptacle comprising a pumping chamber with a variable volume defined at least partly by a deformable membrane, the pump functioning by varying the volume of the pumping chamber by elastic deformation of the deformable membrane between an initial state in which the pumping chamber has a maximum volume and a deformed state in which the volume of the pumping chamber is minimum, the pumping chamber being provided with an inlet orifice and an outlet orifice for the product, the outlet orifice being arranged on the deformable membrane, the outlet orifice being a slot that opens when the pumping chamber deforms and closes when the pumping chamber reverses deformation, wherein the slot comprises two walls of the deformable membrane, wherein the two walls are directly against each other in a closed position and separated from each other in an open position, the pump comprising a means for deforming the deformable membrane configured to exert a pressure on the deformable membrane, the pump further comprising a guide rod passing through the deformable membrane to guide the deformable membrane when it passes from the initial state to the deformed state, the deformable membrane sliding along the guide rod when it undergoes said deformation.

2. The pump according to claim 1, wherein the deformable membrane has a form having in the initial state a longitudinal axis, the guide rod being disposed substantially along said longitudinal axis.

3. The pump according to claim 2, wherein the deformable membrane has a dome shape in the initial state.

4. The pump according to claim 1, wherein the deformable membrane has a dome shape in the initial state.

5. The pump according to claim 4, wherein the deformable membrane comprises an appendage disposed at the crown of the dome, the guide rod passing through the appendage so that the appendage slides along the guide rod when the deformable membrane is deformed.

6. The pump according to claim 5, wherein the outlet orifice is arranged on the appendage.

7. The pump according to claim 6, wherein the deformable membrane undergoes a friction force against the guide rod during deformation so as to cause the opening of the slot.

8. The pump according to claim 7, wherein the appendage comprises an end gripping the guide rod so as to create said friction force.

9. The pump according to claim 5, wherein the means for deforming is a pipe for dispensing the product in contact with the deformable membrane, the pipe cooperating with the outlet orifice sealingly so as to receive the product emerging from the pumping chamber.

10. The pump according to claim 9, wherein the appendage is inserted in the pipe.

11. The pump according to claim 10, comprising a push button provided with the pipe, the push button comprising an opening for dispensing the product in communication with the pipe.

12. The pump according to claim 1, comprising a cylindrical coupling provided with a support wall on which the deformable membrane at least partly rests, the guide rod extending from said support wall.

13. The pump according to claim 12, wherein the support wall comprises the inlet orifice of the pumping chamber, the deformable membrane being provided with a flange covering the inlet orifice so as to form an inlet valve of the pumping chamber.

14. The pump according to claim 13, comprising means for holding the deformable membrane on the support wall.

15. The pump according to claim 12, comprising means for holding the deformable membrane on the support wall.

16. A receptacle comprising the pump according to claim 1.

17. The pump according to claim 1 wherein the slot is able to open without requiring any overpressure in the pumping chamber.

* * * * *